US005103686A

United States Patent [19]

Rosenquist

[11] Patent Number: 5,103,686

[45] Date of Patent: Apr. 14, 1992

[54] LINEAR GEARING

[75] Inventor: Lars Rosenquist, Vretstorp, Sweden

[73] Assignee: Sky Park AB, Stockholm, Sweden

[21] Appl. No.: 597,520

[22] Filed: Oct. 12, 1990

[30] Foreign Application Priority Data

Oct. 16, 1989 [SE] Sweden ..... 8903404

[51] Int. Cl.[5] ..... F16H 27/02; F16H 29/02

[52] U.S. Cl. ..... 74/89.2; 74/89.22

[58] Field of Search ..... 74/89.2, 89.21, 89.22

[56] References Cited

U.S. PATENT DOCUMENTS

| | | | |
|---|---|---|---|
| 3,677,099 | 7/1972 | Cork et al. | 74/89.2 |
| 3,732,742 | 5/1973 | Castaldi | 74/89.2 |
| 4,290,317 | 9/1981 | Hehl | 74/89.2 |
| 4,291,630 | 9/1981 | Fort | 74/89.22 X |
| 4,537,084 | 8/1985 | Passemard et al. | 74/89.2 X |
| 4,647,014 | 3/1987 | Ekman | 74/89.2 X |
| 4,705,455 | 11/1987 | Morita et al. | 74/89.21 X |

*Primary Examiner*—Allan D. Herrmann
*Assistant Examiner*—David W. Laub
*Attorney, Agent, or Firm*—Nies, Kurz, Berger & Tamburro

[57] ABSTRACT

Linear gearing primarily intended for use in connection with so-called transfer tolleys in automatic parking buildings. The transfer trolley includes a first carriage (101) which can be moved in at least a horizontal direction, and a second carriage (102) which is connected to a first carriage for movement from a first end position, in which the second carriage is located within the horizontal extensions of the first carriage, to a second position in which the second carriage has been moved in its longitudinal direction and the longitudinal direction of the first carriage and is located completely outside, or substantially completely outside the horizontal extensions of the first carriage. The invention is characterized in that the linear gearing includes at least two chains, namely a first chain (17A) which runs between two end wheels (16A, 16B) between which a first rod (11) or the like extends, and a second chain (17B) which also runs between two end wheels (16C, 16D) between which a second rod (19) or the like extends, the chains being in mutually spaced, parallel relationship. The first rod (11) is connected to a power source 103) which functions to move the rod (11) in the direction of its longitudinal axis relative to the first carriage (101), and the run or part of the second chain (17B) which is remote from the first chain (17A) is connected to said second carriage (102). The second rod (19) is connected to that run of the first chain 17A) which lies adjacent the run of the second chain (17B) and the run of the second chain (17B) which lies adjacent the run of the first chain (17A) is attached to the first rod (11). The run of the first chain (17A) which is remote from the run of the second chain 17B) is attached to the first carriage (101).

3 Claims, 3 Drawing Sheets

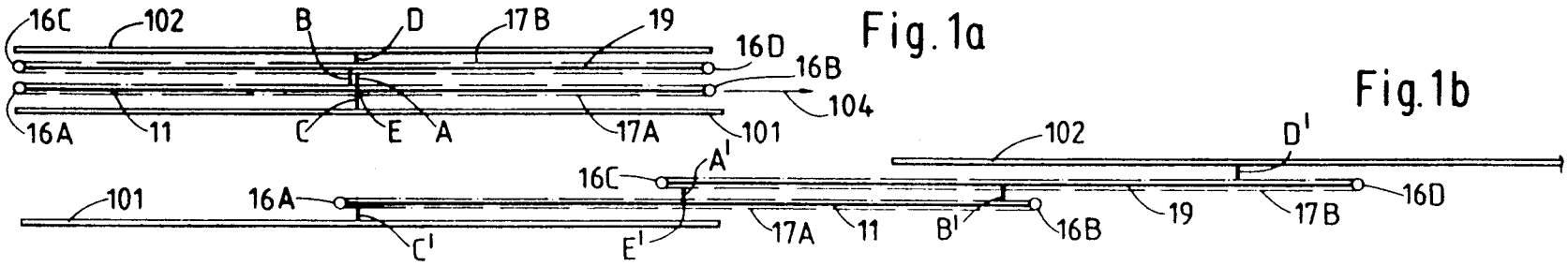
Fig. 1a
Fig. 1b
16C
102
16A
11
101
B
D
17B
19
16D
104
16B
17A
A
E
C
A'
E'
C'
B'
D'
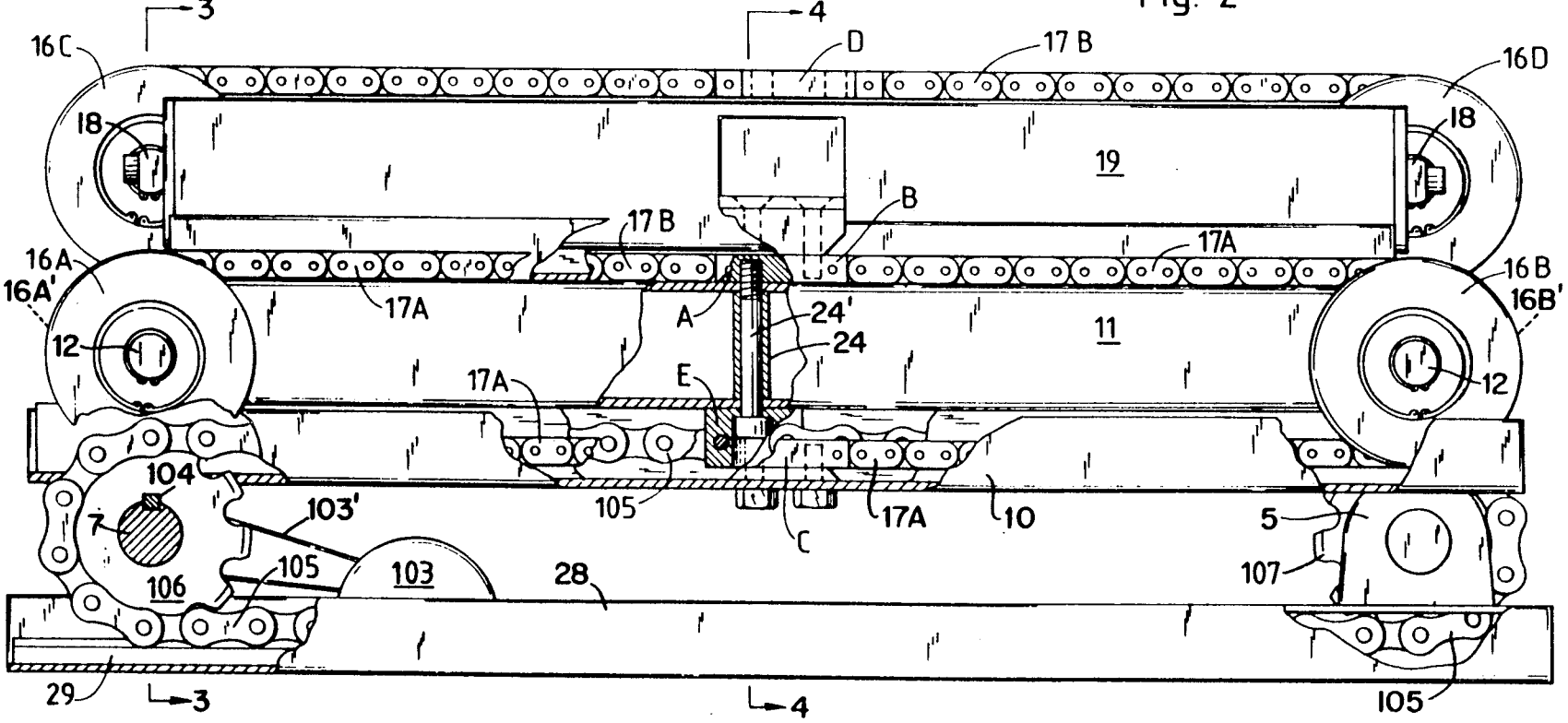
Fig. 2
16D
18
16B
16B'
12
105
5
107
17A
19
11
17B
10
B
D
4
24'
24
C
A
E
28
103
103'
104
106
7
29
3
16C
16A
16A'

LINEAR GEARING

LINEAR GEARING

The present invention relates to linear gearing. The gearing is intended particularly for use in conjunction with automatic parking of vehicles, such as cars, in car-parking buildings in which the cars are transported on a so-called transfer trolley or carriage between a car-receiving or a car-collecting station and a parking place.

BACKGROUND OF THE INVENTION

Field of the Invention

Arrangements for such car-parking facilities are described in Swedish Patent Specification No. 8801396-6 corresponding to U.S. Pat. No. 4,986,714, dated Jan. 22, 1991, entitled "Vehicle Elevator and Conveyor Arrangement". In principle, this patent specification teaches a so-called transfer trolley which can be transported horizontally on rails and vertically with the aid of a lift or hoist arrangement. The transfer trolley is movable in these directions within a vertical shaft which is surrounded by parking places on two mutually opposite and parallel sides thereof. Each side includes a number of floors and each floor, or storey, includes a plurality of mutually adjacent parking places.

The transfer trolley includes a first carriage which supports a second carriage. This second carriage is fixedly connected to the first carriage but movable in relation thereto in the direction of its longitudinal axis. A car in a transport position is raised on the second carriage. The longitudinal axes of the carriages, similar to the longitudinal axis of the car, extend perpendicularly to the longitudinal axis of the shaft.

In brief, the described arrangement functions in the following manner: A car is driven onto the transfer trolley on the bottom floor of the complex, whereafter the trolley is transported horizontally and/or vertically to a position in front of a vacant parking space. The second carriage is then displaced in the direction of its longitudinal axis relative to the first carriage into the parking space, where the second carriage deposits the car. The second carriage is then moved back in over the first carriage, whereafter the whole of the transfer trolley is moved to some other location within the building, in readiness for transporting cars in or out.

When a car is to be transported out, the transfer trolley is moved to the parking place concerned, whereafter the second carriage is moved in beneath the car, and lifts the car and moves the same back in over the first carriage, whereafter the transfer trolley is moved to a delivery station on the bottom floor of the car-parking building.

It will be obvious from this that it must be possible to move the second carriage in relation to the first carriage to an extent in which a car located on the first carriage can be deposited in a parking space at a distance from said carriage which extends so far into said space that the car is completely free from the transfer trolley when said second carriage is drawn-in over the first carriage, subsequent to having deposited the car. In this latter state, the transfer trolley has a length which corresponds to the width of the shaft. Consequently, in order to be positioned so that it is located substantially completely in a parking space, it is necessary to be able to displace the second carriage relative to the first carriage to an extent such as to locate the second carriage essentially completely outside the confines or outer extensions of the first carriage, or in a position edge-to-edge with said first carriage. The need for this extensive carriage displacement is complicated by the fact that the only available length for the carriage-displacement mechanism is the length of the transfer trolley, which corresponds to the width of the shaft.

This problem is solved in a highly advantageous manner by means of the present invention, where the length of the drive device or carriage displacement mechanism is much shorter than the length of the transfer trolley.

SUMMARY OF THE INVENTION

The present invention thus relates to linear gearing primarily intended for use in connection with a so-called transfer trolley in automatic parking buildings, said transfer trolley comprising a first carriage which is movable at least horizontally, and a second carriage which is movably connected to the first carriage for movement from a first terminal position in which said second carriage is located within the horizontal confines of the first carriage, to a second terminal position in which the second carriage has been moved in the direction of its longitudinal axis and also in the direction of the longitudinal axis of said first carriage and is located completely or substantially completely outside the first extension in the horizontal plane, and is characterized in that the linear gearing includes at least two endless looped chains, namely a first chain which extends between two end wheels which have a first rod, or beam, extending therebetween, and a second chain which also extends between two end wheels and between which a second rod, or beam, extends, said chains being arranged in mutually parallel spaced relationship; and in that the first rod is connected with a power source which functions to move the rod in the direction of its longitudinal axis relative to said first carriage; in that the run of the second chain remote from the first chain is attached to the second carriage; in that the second rod is connected to that run of the first chain which is closest to the second chain; in that the run of the second chain which is closest to the first chain is connected to the first rod; and in that the run of the first chain which is remote from the second chain is attached to the first carriage.

BRIEF DESCRIPTION OF THE DRAWING

The invention will now be described in more detail with reference to an exemplifying embodiment thereof illustrated in the accompanying drawings, in which FIGS. 1*a* and 1*b* are schematic representatives which illustrate the principles of the present invention, FIG. 1*a* showing the linear gearing fully retracted and FIG. 1*b* showing the linear gearing fully extended;

FIG. 2 is a detailed, partially broken away, side view of the inventive arrangement;

DESCRIPTION OF THE PREFERRED EMBODIMENTS

Figure 3:
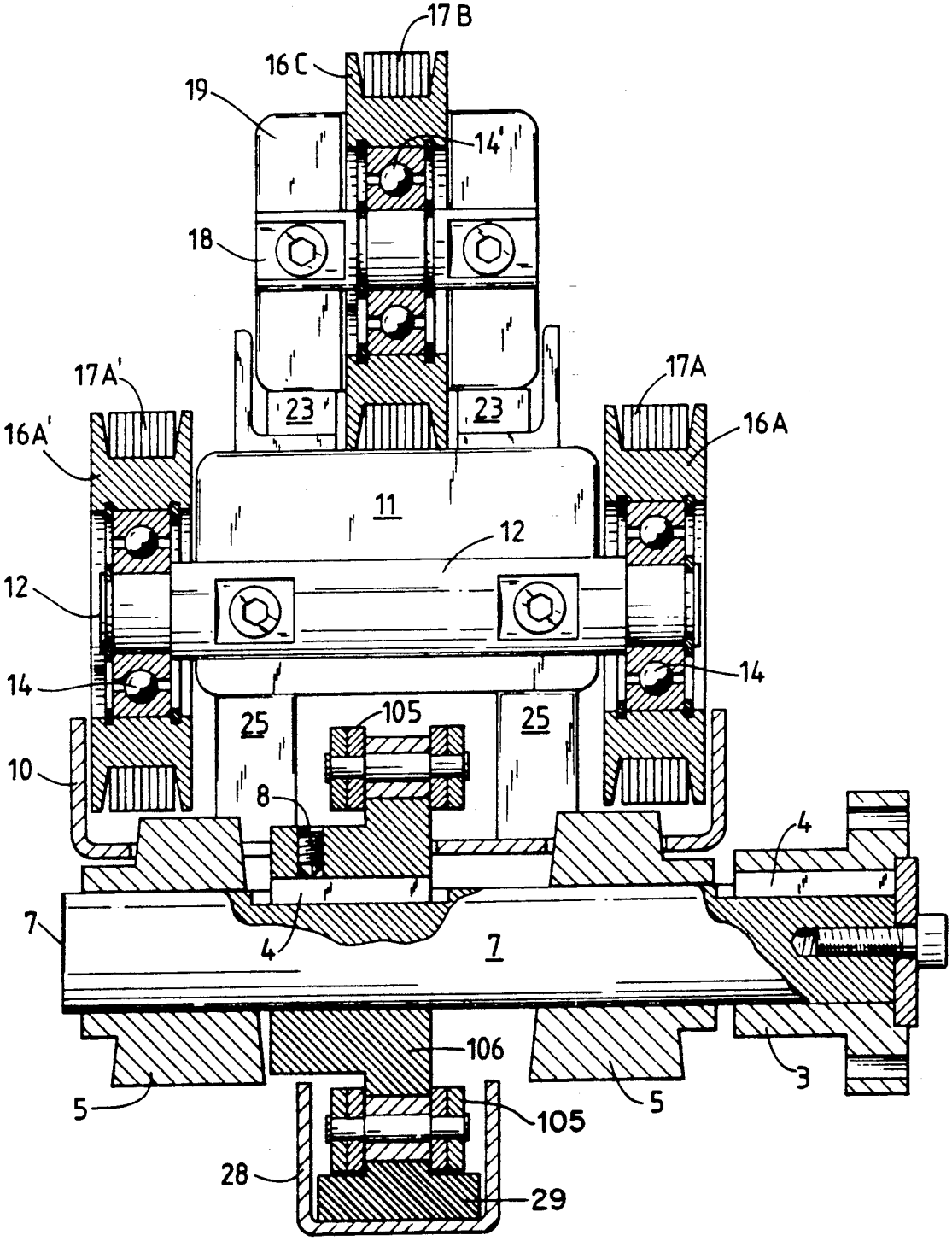
FIG. 3 is a sectional view taken on the line 3—3 in FIG. 2.
Figure 4:
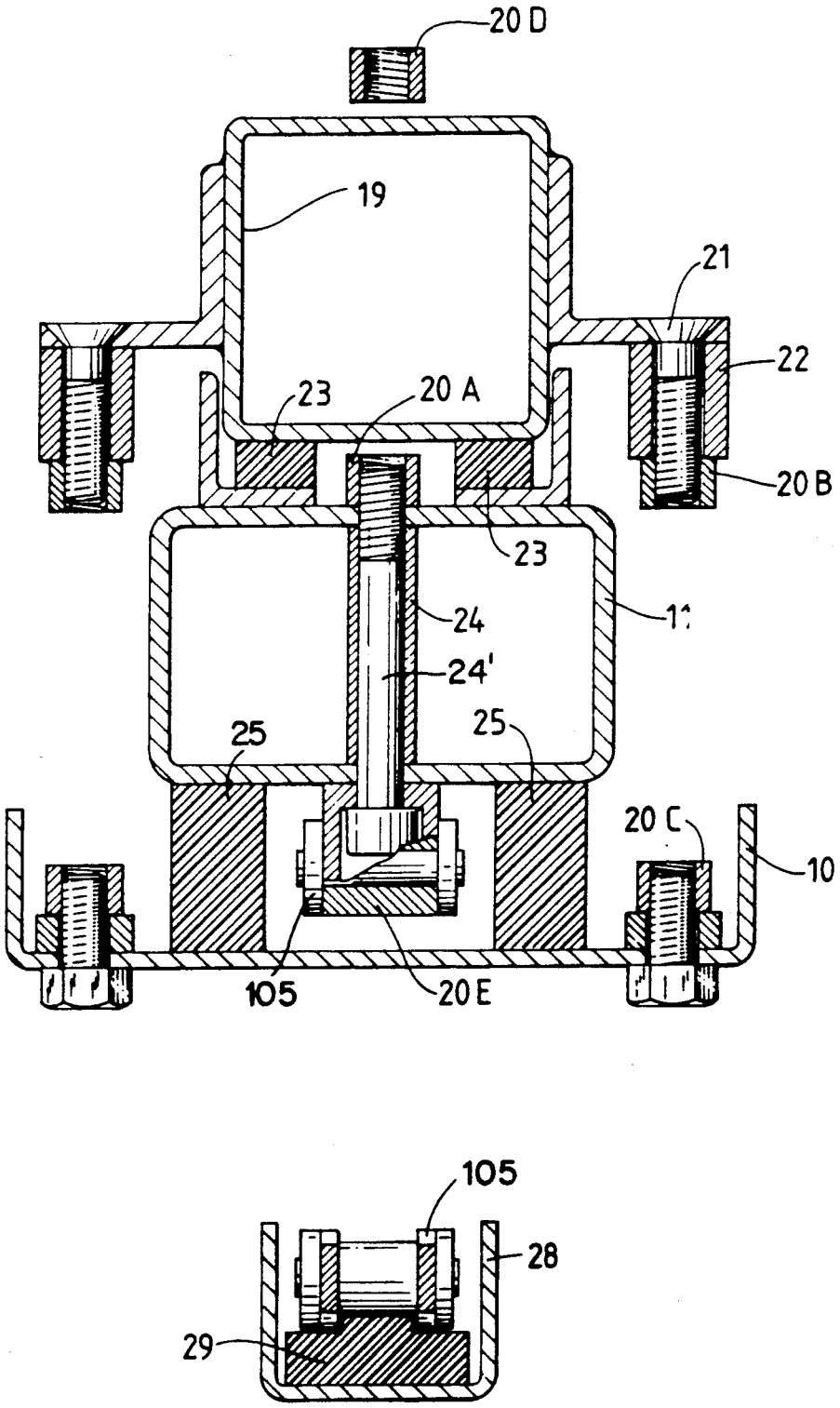
FIG. 4 is a sectional view taken on the line B—B in FIG. 2; excluding the chains.

The reference numerals or signs used in FIGS. 3 and 4 identify the following components: Reference 3 identifies a motor mounting flange; reference 4 identifies a wedge or key; reference 5 identifies a bearing; reference 106 identifies a chain wheel; reference 7 identifies a drive shaft; reference 8 identifies a stop screw; reference 105 identifies a drive chain; reference 10 identifies a U-profile section; reference 11 identifies a thrust beam or rod; reference 12 identifies an axle shaft; references 14 and 14' identifies bearings; references 16A, 16A' and 16C identify chain wheels reference 17A identifies a chain; reference 18 identifies an upper axle shaft; reference 19 identifies an upper thrust beam or rod; reference 17B identifies an upper chain; references 20A, 20B, 20C, 20D identify attachment devices; reference 21 identifies a screw; reference 22 identifies a spacer; reference 23 identifies a slide profile; reference 24 identifies a spacer tube; reference 25 identifies a slide profile; reference 28 identifies a U-profile; reference 29 identifies a slide profile for the bottom run of the drive chain 105; and reference 20E identifies an attachment member.

FIG. 2 is a side view of the inventive arrangement. The principles on which the inventive arrangement is constructed and operates will best be seen from FIG. 1. As beforementioned, the invention is concerned with a linear gearing intended primarily for use with a so-called transfer trolley in automatic parking buildings, this transfer trolley including a first carriage 101 which can be moved in at least a horizontal direction, and a second carriage 102 which is movably connected to the first carriage. In FIG. 1 the reference 101 identifies the first carriage and the reference 102 the second carriage. The carriages are illustrated highly schematically and are not shown in FIGS. 2-4. The linear gearing of FIGS. 2-4 is located between the carriages 101, 102, as seen in FIG. 1.

The second carriage can be moved relative to the first carriage, by means of said linear gearing, from a first end position, shown in FIG. 1*a*, in which the second carriage 102 is located within the horizontal confines or extension of the first carriage 101, to a second end position, shown in FIG. 1*b*, in which the second carriage 102 has been moved in the direction 104 of the longitudinal axis of the first carriage 101 and is located completely outside, or substantially completely outside the extension or confines of the first carriage 101 in the horizontal plane.

The linear gearing includes at least two endless chains, namely a first chain 17A which runs between two end wheels 16A, 16B between which a first body 11 extends, and a second chain 17B which also runs between two end wheels 16C, 16D, between which a second beam or rod-like body 19 extends. The chains are arranged in mutually parallel spaced-apart, upper and lower relationship. In the case of the illustrated embodiment, the first chain 17A is one of a pair which comprises two mutually parallel side-by-side endless chains 17A and 17A', each arranged on an associated pair of wheels, respectively 16A, 16B and 16A' and 16B' (not shown but behind wheel 16B in FIG. 2), as will be seen from FIG. 3. In FIGS. 2 and 3, the lower chain wheels 16A and 16A' are rotatable on bearings 14 secured on a shaft 12 which in turn is secured with its axis in lateral disposition on one end of the lower beam 11, and the opposite end chain wheels 16B and 16B' are similarly rotatably carried on an axle shaft 12 secured with its axis disposed laterally on the other end of the lower beam 11. The upper chain wheels 16C and 16D are rotatably mounted by similar roller bearings 14 on short axle shafts 18 secured with axes in lateral disposition on respective ends of the upper beam 19.

The chains, the carriages and a power source are mutually connected in the following manner:

The first beam or rod 11 is connected to a power source 103 (see FIG. 2) which functions to move the rod 11 on slides 25 in the U-profile channel 10 in the direction of its longitudinal axis in relation to the first carriage 101, as shown by the arrow 104 in FIG. 1*a*. The point of connection between the power source and beam or rod 11 is referenced E in FIGS. 1 and 2, and with the reference sign 20E in FIG. 4. That run or part of the second chain 17B which is remote from the first chain 17A (see FIG. 2) is attached to the second carriage 102 which point of attachment is referenced D in FIGS. 1 and 2, and with the reference 20D in FIG. 4.

The second beam or rod 19 is connected by angles, screws 21, spacers 22 and connector 20B to that run or part of the first chain 17A which is adjacent the second chain 17B. The point of connection is referenced B in FIGS. 1 and 2, and with the reference 20B in FIG. 4.

That lower run or part of the uppermost second chain 17B which is adjacent the lowermost or first chain 17A is attached by a bolt 24A', spacer sleeve 24 and connector 20A to the first rod 11. The point of attachment is referenced A in FIGS. 1 and 2, and with the reference 20A in FIG. 4.

That run or part of the lowermost or first chain 17A which is remote from the uppermost or second chain 17B is attached via the U-profile channel section 10 to the first carriage 101. The point of connection is referenced C in FIGS. 1 and 2, and with the reference 20C in FIG. 4.

According to the preferred embodiment, in the retracted position the connections A, B, C, D and E between the first and second chain parts, the first and the second rod and the first and second carriage respectively are located essentially along a straight line which extends perpendicularly to the longitudinal axes of the rods, approximately centrally between said wheels, as will be seen from FIG. 1*a* and FIG. 2.

According to another the disclosed preferred embodiment of the invention, the power source includes a third chain 105 which runs between two wheels 106, 107 mounted on spaced-apart axle shafts 7 which are rotatably mounted in bearing blocks 5 which in turn are secured (not shown) to the lower carriage 101. This chain 105 is placed between the first chain 17A and the first carriage 101. The power source includes a motor, not shown, preferably an hydraulic motor which is intended to drive one, 106, of the last-mentioned wheels via the motor flange 3 (FIG. 3), keyed by key 4 to the drive axle 7 for wheel 106. Alternatively, a motor 103 (shown in FIG. 2) can drive the axle 7 and wheel 106 by a belt or chain drive connection 103'.

The linear gearing operates in the following manner:

The power source 103, i.e. the power drive chain 105 with associated motor, drives the first rod 11, which can slide on the slides 25 in U-profiled channel 10 (FIGS. 3 and 4), to the position E' shown to the right in FIG. 1*b*, via the attachment E. Since the lower chain 17A is connected to the first carriage 101, through the attachment C, the chain 17A rolls around its wheels, 16A and 16B, and the upper run of that lower chain 17A, including its attachment B to the upper or rod 19, will be driven to the right in FIG. 1. The upper beam or rod 19 will therewith be moved to the right as shown in FIG. 1*b* riding on the slide profiles 23 provided on top of the beam 11 (see FIG. 3). Since the bottom run of the upper chain 17B is connected to the lower beam or rod 11, by means of the attachment A, the upper run of chain 17B will also be driven to the right on its wheels 16C and 16D in relation to the upper rod 19. The attachment point A is accomplished by means of a bolt 24' which passes through a connection part E (20E) on the power driven chain 105, through the lower and upper walls of beam or rod 11 and screws into a connection part A (20A) on the lower run of upper chain 17B. Between the upper and lower walls of beam 11 the bolt 24' passes through a spacer 24 which provides a structural support between the upper and lower beam walls when the bolt 24' is tightened. The attachment D from upper run of upper chain 17B to the upper or second carriage 102 is therewith driven to the position referenced D' in FIG. 1*b* and hence drives the attached carriage 102 to the full right-hand extension position. This gearing arrangement provides a four fold transmission between movement of the power source chain 105 and movement of the attachment D.

It will be evident that the gearing causes the second carriage 102 to move relative to the first carriage 101 from a position in which the second carriage is located on and above the first carriage, as illustrated in FIG. 1*a*, to a position in which the second carriage 102 is located completely outside the extension of the first carriage 101, as illustrated in the FIG. 1*b*.

The invention thus provides a stable, compact and operationally reliable gearing which solves completely the problems defined in the introduction.

It will be understood that the illustrated embodiments can be modified in many respects obvious to one of normal skill in this art. For instance, the illustrated exemplifying embodiment of the inventive gearing has been shown to include mutually superposed chains.

The chains, however, can be arranged horizontally adjacent one another, or in some other orientation. Furthermore, although the illustrated power source comprises a chain 105 and a hydraulic motor 103, it will be understood that the power source may comprise a hydraulic piston-cylinder device mounted between the attachment E and the first carriage and functioning to displace the first rod.

The gearing may also be expanded to include a further chain and rod or further chains and rods which are connected to the second chain (17A) of the illustrated embodiment, so as to provide a four-fold, six-fold or eight-fold transmission system.

The present invention shall not therefore be considered to be limited to the aforedescribed embodiments, since modifications can be made within the scope of the following claims.

I claim:

1. Linear gearing for use in connection with so-called transfer trolleys in automatic parking buildings, wherein the transfer trolley includes a first carriage (101) which can be moved in at least a horizontal direction, and a second carriage (102) which is connected to the first carriage for movement from a first retracted position, in which the second carriage is located within the horizontal extensions of the first carriage to a second extended position in which the second carriage has been moved in its longitudinal direction and the longitudinal direction of the first carriage to a location essentially completely outside the horizontal extensions of the first carriage, wherein the linear gearing includes at least two endless chain drives comprising: a first chain drive including an endless chain 17A, a first set of two spaced-apart end wheels (16A and 16B) around which said chain (17A) runs, and a first rod means (11), with two ends, extending between said first set of two spaced apart end wheels, having means adjacent each end journalling an associated one of said first set of two end wheels on horizontal axes; and a second chain drive with a second endless chain 17B and a second set of two spaced-apart end wheels (16C and 16D) around which said second endless chain (17B) runs, and a second rod means (19), with two ends, extending between said second set of two spaced-apart end wheels, having means adjacent each end journalling an associated one of said second set of two end wheels on horizontal axes; said chain drives being in mutually spaced-apart, parallel relationship with the second chain drive disposed above the first chain drive; a power source having a first connector means (E) connected to the first rod means (11); said power source (103) being adapted to move the rod means (11) in the direction of its longitudinal axis relative to the first carriage (101); wherein the run of the second endless chain (17B) which is positioned remote from the first endless chain (17A) includes a second connection means (D) connected to said second carriage (102); wherein the second rod means (19) has a third connection means (B) connected to that run of the first endless chain (17A) which lies adjacent the run of the second endless chain (17B); wherein the run of the second endless chain (17B) which lies adjacent the run of the first endless chain (17A) includes a fourth connection means (A) attached to the first rod (11); and wherein the run of the first endless chain (17A) which is remote from the run of the second endless chain (17B) includes a fifth connection means (C) by which it is attached to said first carriage (101).

2. Linear gearing according to claim 1, wherein at said first retracted carriage position, the five named connection means (A–E) between the runs of the first (17A) and the second (17B) endless chains, the first (11) and the second (19) rod means and the first (101) and the second carriage (102) are located substantially along a straight line which extends perpendicularly to the longitudinal axes of the rods (11, 19) approximately centrally between all of said wheels (16A–16D) in said two sets of wheels in said two linear chain drives.

3. Linear gearing according to claim 1, wherein said power source is mounted on said first carriage (101) and includes a third endless chain (105) and a third set of two spaced apart wheels (106, 107), about which said third endless chain runs; said third endless chain (103) and its set of two wheels being positioned between the first chain drive and the first carriage (101); and wherein the power source also includes a motor and a connection to at least one of said third set of two wheels, to drive rotate one (106) of the lastmentioned wheels and said third endless chain and said connection between said power source and said first rod (11) is a connection between said third endless chain and said first rod (11).

* * * * *